United States Patent [19]

Meier

[11] 4,342,326

[45] Aug. 3, 1982

[54] HIGH SPEED STRIPPING APPARATUS

[76] Inventor: Paul L. Meier, Strip-Ease, Inc., Hwy. 17, Martin, Ga. 30557

[21] Appl. No.: 230,002

[22] Filed: Jan. 30, 1981

[51] Int. Cl.[3] ..... B08B 3/02

[52] U.S. Cl. ..... 134/102; 134/199; 134/200; 239/338

[58] Field of Search ..... 239/338; 134/94, 100, 134/101, 102, 199, 200

[56] References Cited

U.S. PATENT DOCUMENTS

| | | | |
|---|---|---|---|
| 1,492,957 | 5/1924 | Bots | 134/94 X |
| 1,763,904 | 6/1930 | Rouse | 134/94 X |
| 1,978,721 | 10/1934 | Perkins | 134/102 X |
| 2,811,975 | 11/1957 | Tatibana | 134/102 |
| 3,120,237 | 2/1964 | Lang | 134/102 |
| 3,181,541 | 5/1965 | Brooking | 134/186 |
| 3,231,424 | 1/1966 | Evans et al. | 134/38 |
| 3,353,546 | 11/1967 | Mahoney | 134/123 |
| 3,734,109 | 5/1973 | Hebner | 134/64 |
| 3,930,513 | 1/1976 | Buchegger et al. | 134/172 |
| 4,116,387 | 9/1978 | Kremer, Jr. et al. | 239/338 |
| 4,170,240 | 10/1979 | Gentry | 134/57 |

OTHER PUBLICATIONS

Sketch of portable paint stripping gun used by applicant.

p. 2 of Spraying Systems Co. catalog (Industrial Catalog 27).

*Primary Examiner*—Robert L. Bleutge

*Attorney, Agent, or Firm*—Howson and Howson

[57] ABSTRACT

A high speed furniture stripping apparatus of the solvent recirculating type comprises an array of solvent-carrying tubes within an enclosure. The solvent-carrying tubes have spray nozzles in their side walls, and internal air-carrying tubes, coaxial with the solvent tubes and having pin holes aligned with the solvent nozzles. When air is supplied to the air tubes under pressure, blasts of air from the pin holes atomize the solvent into fine droplets and project the droplets at high velocity against the furniture. Each of the air tubes is affixed to a nipple threaded into an end wall of a solvent-carrying tube. Rotation of the nipple adjusts the relationship between the nozzles and the pin holes for optimum spray conditions.

4 Claims, 5 Drawing Figures

HIGH SPEED STRIPPING APPARATUS

BRIEF SUMMARY OF THE INVENTION

This invention relates to improvements in stripping apparatuses of the type used for removing finishes from articles of wooden furniture. While the invention will be described with reference to a stripping apparatus particularly designed for removing finishes from wooden furniture, the invention has utility in removing various types of finishes, including paints, varnishes, lacquers and the like from articles other than furniture, including articles made of wood, or metal, or various other materials.

In the furniture refinishing industry, several types of stripping machines are known. A common type of machine comprises a tank containing a bath of solvent, in which the article to be stripped is dipped for a period of time until the finish is removed. Another known type of stripping machine comprises an enclosure in which solvent is sprayed onto the article of furniture. In a typical stripper of the spray type, the solvent is collected and recirculated to the spray nozzles through a pump.

There are two major problems in the operation of conventional stripping machines of the bath type and of the spray type. One such problem is the slow speed with which prior devices operate. Even with the strongest available solvents, it usually takes from about forty five minutes or more, and sometimes up to several hours, to remove the finish effectively from an article of furniture. The time required for stripping furniture becomes particularly significant in large operations where large numbers of articles of furniture are to be refinished.

Another related problem pertains to the quality of the work accomplished by conventional stripping machines. It is particularly difficult with conventional machines to remove finishes from crevices, spindles, carvings and cracks on wooden furniture. With conventional equipment, if the time of exposure of the solvent is short, removal of finish may be inadequate at the location of these crevices, spindles, etc. On the other hand, if exposure time is adequate to effect complete removal of the finish, both time and energy are wasted.

This invention is an improved stripping apparatus of the spray type. While prior spray-type strippers have used liquid pumps to effect spraying, and some have used liquid pumps together with air boosters, the present invention uses compressed air much more effectively than in the past to aid a solvent in removing a finish from an article of furniture or the like. In accordance with the invention, an enclosure is provided with an array of elongated tubes arranged on its interior walls. The side walls of these tubes have nozzles arranged to deliver liquid solvent from the interiors of the tubes to the space outside of the tubes but within the enclosure. A pump collects solvent from the bottom of the enclosure, and pumps the solvent into the tubes, where it is released in spray form through the nozzles. Preferably, a heating device is provided within the enclosure, but isolated from the solvent by a suitable partition. As solvent collects on the partition, it is heated, and is pumped into the array of tubes in a heated condition so that it removes finishes more rapidly and effectively than it would if cool.

Extending lengthwise within the elongated, solvent-carrying tubes, are stainless-steel air tubes. These air tubes extend through end closures in the elongated solvent-carrying tubes. Seals are provided to prevent leakage of solvent so that the solvent-carrying tubes can fill up with solvent without any resulting leakage through the openings provided for the air tubes. The air tubes are provided with transverse pin-hole openings. These pin-hole openings are accurately aligned with the openings of the solvent nozzles. Air pressure is applied to the air-carrying tubes from a compressor through a suitable control valve. Upon opening the control valve, a blast of air is blown through each pin-hole opening. When the air is turned on, the velocity of the air passing through the solvent nozzles reduces the liquid solvent to extremely fine droplets, and at the same time projects these droplets against the article of furniture at high velocity.

It has been found that the air blast, acting directly through the nozzle openings produces a much more effective stripping action than has been achieved heretofore, both in terms of time reduction, and in terms of quality of results. In some cases, high quality results can be achieved in approximately one-third the time required to achieve the same results with conventional spraying equipment, whether using a liquid pump alone, or using a liquid pump with an air assist.

In order to achieve the desired results, another aspect of the invention comes into play. Accurate alignment of the pin-hole openings of the air tube with the nozzles in the solvent-carrying tube is important to the proper functioning of the apparatus, but not easily achieved by conventional techniques. In accordance with the invention, the elongated, solvent-carrying tubes have end closures with internally threaded passages. Tubular nipples are threaded into these passages. The elongated, stainless-steel air-carrying tubes are welded to the nipples so that they cannot rotate relative to the nipples. The nipples are provided with reference markings having a known relationship with the series of pin-hole openings in the stainless-steel air tubes to which they are secured. These reference markings permit a determination of the position of the pin-hole openings relative to the nozzles. With this arrangement, by turning the nipples until the reference markings are in the desired positions, the pin-hole openings can be accurately aligned with the nozzles even though they are effectively invisible because they are hidden within the solvent-carrying tubes. Furthermore, the positions of these pin-hole openings can be readily adjusted by rotation of the nipples for optimum performance. In testing for optimum spray characteristics, the spray can be observed by pumping water through the system with the enclosure in an opened condition.

The principal object of this invention is to provide a stripping apparatus capable of very high speed operation, and at the same time capable of producing high quality results. It is also an object of this invention to provide a stripping apparatus which is inexpensive to manufacture, and which is inexpensive to operate. Various other objects of the invention will be apparent from the following detailed description when read in conjunction with the drawings.

DETAILED DESCRIPTION

Figure 1:
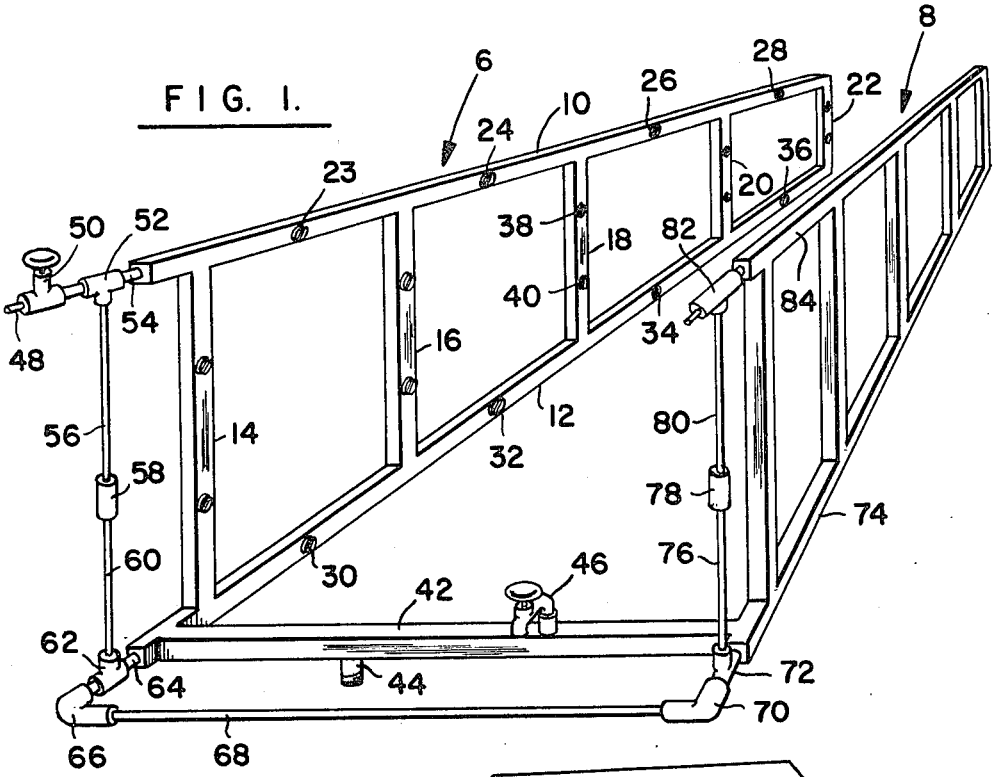
FIG. 1 is an oblique perspective view of the solvent tube array in a high speed stripping apparatus in accordance with the invention.

The array of solvent-carrying tubes comprises two ladder-like assemblies 6 and 8, as shown in FIG. 1. These ladder-like assemblies are adapted to be supported on opposite side walls of an enclosure. Each preferably comprises steel tubes having a square cross-section, the various tubes in the array being welded together.

Ladder-like array 6 comprises upper and lower parallel, elongated, horizontally disposed tubes 10 and 12, which are interconnected by vertical tubes 14, 16, 18, 20 and 22.

Tube 10 is provided with nozzles 23, 24, 26 and 28 in its side wall facing the opposite ladder-like array 8. These nozzles are conventional nozzles which are threaded into the side wall of tube 10. Each comprises a through hole, and a V-shaped groove which determines the spray angle and pattern. These nozzles are spaced at equal intervals along tube 10. Similar nozzles 30, 32, 34 and 36 are arranged on lower elongated tube 12. The vertical interconnecting tubes may also be provided with nozzles such as nozzles 38 and 40 on tube 18.

Tubular array 8 is provided with a similar pattern of nozzles, all facing tubular array 6. The two tubular arrays are interconnected by tube 42 so that solvent can flow freely from inlet opening 44 to any location within the interior of either of arrays 6 and 8. A valved outlet is provided at 46 for draining solvent from the tubes.

An air inlet connection is provided at 48 for connection to an air compressor reservoir. The air supply is connected through air valve 50 to a T-connector 52. The opposite opening of the T-connector is connected to an air nipple 54 through which air is delivered to an internal air-carrying tube within solvent tube 10. Each of the horizontally extending elongated tubes in both arrays has an internal air-carrying tube, the details of which will be apparent from reference to FIGS. 4 and 5.

The vertical leg of T-connector 52 is connected through tube 56, connector sleeve 58, and tube 60 to the vertical leg of another T-connector 62. This T-connector provides air to the air tube within solvent tube 12 through nipple 64. An elbow connector 66, tube 68, and elbow connector 70 deliver air to the opposite side of the assembly. From elbow 70, air is delivered through T-connector 72 to an air tube within solvent tube 74. Air is also delivered through tube 76, connector sleeve 78, tube 80 and T-connector 82 to an air tube within solvent tube 84.

Figure 2:
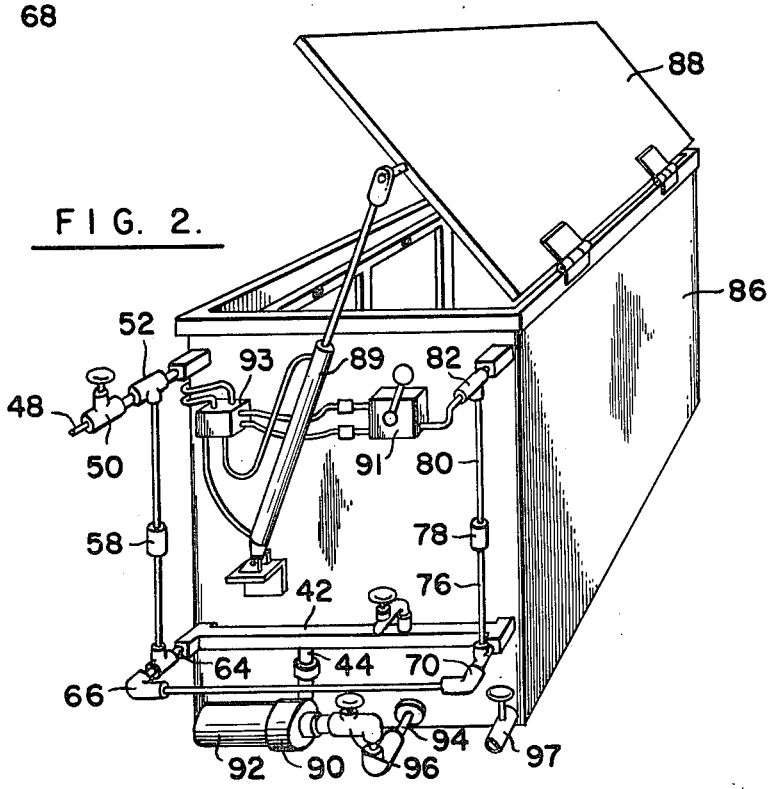
FIG. 2 is an oblique perspective view of a stripping apparatus in accordance with the invention, showing the enclosure, and also showing the solvent recirculation pump, and other exterior plumbing details.

Referring to FIG. 2, the ladder-like arrays are arranged along opposite horizontally elongated vertical walls of enclosure 86. This enclosure has a hinged cover 88. The near end of the assembly shown in FIG. 1 is located on the outside of an end wall of the enclosure as shown in FIG. 2. A liquid pump 90, driven by an electric motor 92 recovers solvent from a solvent well within the enclosure through pipe 94 and valve 96. The pump delivers solvent to the tubular arrays through connection 44 underneath tube 42. A drain valve is provided at 97 to allow emptying of solvent from the enclosure.

Cover 88 of the enclosure is opened and closed by a pair of double-acting air cylinders, one of which is shown in FIG. 2 at 89. Air for operating these cylinders is derived from T-connector 82 and delivered to the cylinder through control valve 91 and distributor 93.

Figure 3:
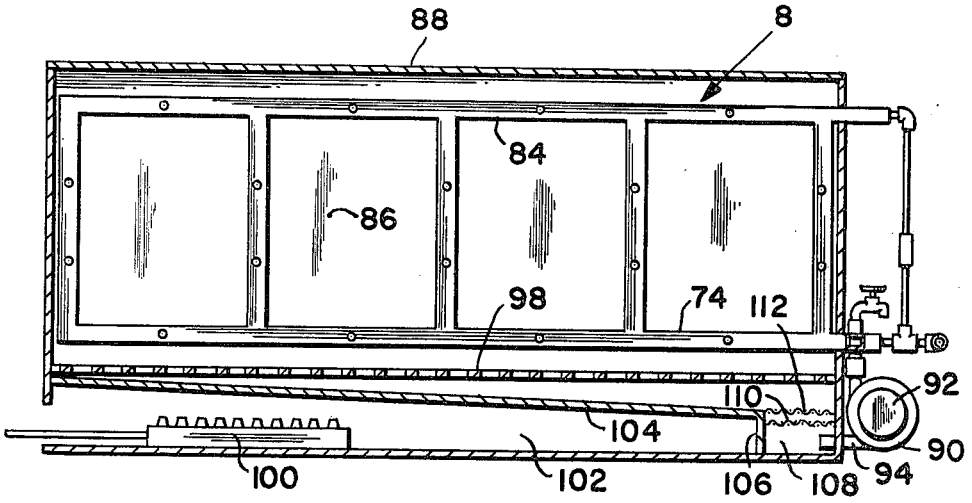
FIG. 3 is a longitudinal cross-section of the stripping apparatus, showing the relationship between the enclosure and the array of solvent-carrying tubes on one wall thereof, and also showing the furniture-support screen, the heater, the partition which isolates the heater from the solvent, and the solvent collection well.

Referring to FIG. 3, which shows tubular array 8 arranged against side wall 86 of the enclosure, it will be seen that the array is located above a horizontally extending expanded metal screen 98, which serves to support furniture and other articles within the enclosure, while allowing solvent to flow through to the bottom of the enclosure. A gas heater is provided at 100 within a heater compartment 102, which is isolated from the upper part of the enclosure by a sloping metal partition 104, and a vertical partition 106. To the right of vertical partition 106 is a well 108, in which solvent accumulates as it falls through support screen 98 and flows down along partition 14. A double-filter strainer consisting of screens 110 and 112 is located over well 108 to prevent sludge from being recirculated. Solvent from well 108 is picked up, and flows through pipe 94 into pump 92, through which it is recirculated. Solvent is heated as it flows along sloping partition 104.

Figure 4:
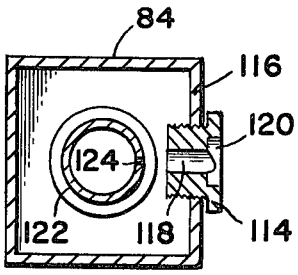
FIG. 4 is a transverse cross-section of a solvent-carrying tube, showing a solvent spray nozzle, and its relationship with an internal air tube.
Figure 5:
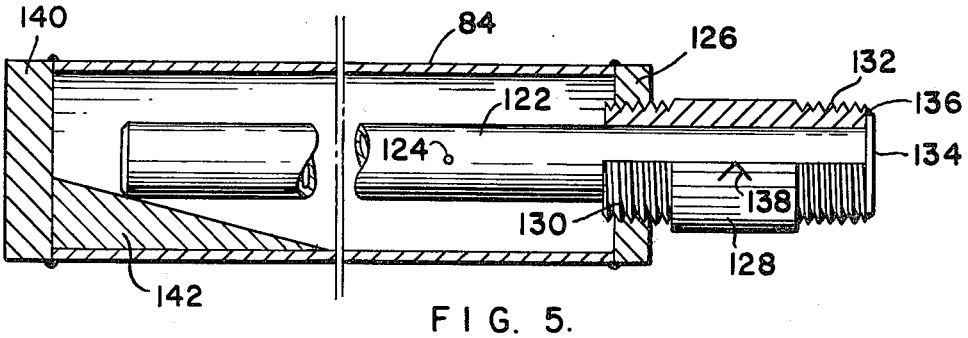
FIG. 5 is a partially broken away longitudinal section of a solvent-carrying tube, showing an internal air tube and an air tube adjustment nipple.

FIGS. 4 and 5 show how the air-carrying tubes are related to the horizontally elongated solvent-carrying tubes. As shown in FIG. 4, solvent-carrying tube 84 has a square crosssection, and a nozzle 114 is threaded into its side wall 116. This nozzle has a through hole 118, and a V-shaped groove 120. Arranged coaxially within solvent tube 84 is an air-carrying tube 122, which has a series of pin-hole openings, one of which is shown at 124. Pin-hole opening 124 is aligned with nozzle through hole 118. In normal operation of the apparatus, the space within tube 84, but outside tube 122 is substantially filled with solvent. Air under high pressure within tube 122 forms a jet at opening 124, which forces solvent outwardly through the nozzle opening. The air jet atomizes the solvent into very fine droplets, and at the same time projects them at high velocity against the article of furniture or other object within the enclosure.

In order to enable the pin-hole openings in the air-carrying tube to be accurately aligned with the openings of the nozzles, the assembly shown in FIG. 5 is used. Tube 84 is provided with an end wall 126, which has a threaded opening into which is threaded a nipple 128. This nipple has threads on its opposite ends. The set of threads at 130 are engaged with the internal threads of end wall 126, and threads 132 are provided for connection to an air distribution elbow or T-connector. Tube 122 has a flared end 134 which is electrically welded or otherwise suitably secured to the face of nipple 128 at 136 so that the tube and nipple cannot rotate relative to each other. The weld at 136 preferably extends all the way around the flared end 134 of the tube to prevent leakage of solvent. The air tube 122 is preferably stainless steel, while the nipple can be any suitable steel or other metal. A marking is provided on the exterior of the nipple at 138. This marking has a known relationship to the series of pin holes in tube 122 so that the positions of the pin holes can be determined from the outside of the solvent-carrying tube. The far end of the air-carrying tube is supported near the opposite end wall 140 on a wedge 142 as shown in FIG. 5 so that the solvent and air tubes remain in coaxial relationship with each other. Wedge 142 raises the far end of air tube 122 to the desired height when it is inserted in solvent-carrying tube 84.

The relationship between the pin holes and the air tube and the openings of the nozzle can be readily adjusted by rotation of nipple 128. Once the desired relationship is established by experimentation with water, and observation of the spray patterns, the nipple can be secured in fixed relationship to end wall 126 by cement or by other suitable means.

The stripping apparatus in accordance with this invention can be used with a variety of solvents, but operates best with comparatively non-volatile water-soluble mixtures. An example of a mixture which has been found suitable for use with this apparatus is a solvent known as "StripEase #500" available from Strip-Ease, Inc., Highway 17, Martin, Ga. This solvent is a mixture of water, sodium hydroxide, ethylene glycol, phenyl ether, nitrilotriacetic acid trisodium salt, and sodium hypochlorite. Stripping compounds containing highly volatile solvents can be used with this stripping apparatus, but are generally more expensive, and are less satisfactory because of their flammability and their tendency to evaporate.

Using the apparatus with the above mixture, it is possible to strip varnish from most articles of furniture in less than a minute. Most paints can be removed from wooden articles in a matter of a few minutes, depending on the number of coats.

Modifications, of course, can be made in the arrangement of tubes. For example, if desired additional spraying tubes can be provided underneath the lid of the enclosure and on its end walls. Modifications can be made in various other aspects of the apparatus without departing from the scope of the invention, as defined in the following claims.

I claim:

1. A stripping apparatus comprising an enclosure, an array of elongated tubes located within the enclosure, said tubes having side walls with a plurality of nozzles in the side walls arranged to deliver liquid solvent from the interior of the tubes to the space outside of the tubes but within the enclosure, means for collecting liquid solvent at the bottom of the enclosure, pump means, having an intake in communication with the collecting means and an outlet in communication with the array of tubes, for delivering liquid solvent collected at the bottom of the enclosure to the interiors of the tubes in the array, at least one of the elongated tubes in the array having an additional internal tube with a series of transverse pin-hole openings, said internal tube being positioned within said one of the elongated tubes and being spaced from the side walls thereof so that a space for flow of liquid solvent surrounds the internal tube substantially completely, and so that each pin-hole opening is in register with one of the nozzle openings of said one of the elongated tubes, and means for supplying compressed air to said internal tube, whereby blasts of compressed air from said pin-hole openings are directed through said nozzle openings and project fine liquid solvent droplets from said nozzle openings at high velocity.

2. A stripping apparatus according to claim 1 in which said one of the elongated tubes has an end closure at one end with an internally threaded passage, in which said one of the elongated tubes has a tubular nipple with an internal passage, the nipple being threaded at least at one end, the threads of the tubular nipple being engaged with the internal threads of the end closure, in which said additional internal tube extends into the internal passage of said tubular nipple and is secured against rotation relative to the nipple, and in which said nipple has an indicator marking permitting determination of the position of the pin-hole openings in the additional internal tube relative to the nozzles, whereby the relationship between the pin holes and the nozzles can be accurately adjusted by rotation of the nipple.

3. A stripping apparatus according to claim 1 in which said one of the elongated tubes has an end closure at one end with an internally threaded passage, in which said one of the elongated tubes has a tubular nipple with an internal passage, in which said additional internal tube extends into the internal passage of said tubular nipple and is secured against rotation relative to the nipple, and in which the nipple is threaded at least at one end, the threads of the tubular nipple being engaged with the internal threads of the end closure whereby the relationship between the pin holes and the nozzles can be accurately adjusted by rotation of the nipple.

4. A stripping apparatus according to claim 1 including means mounting said additional internal tube for rotation whereby the relationship between said pin-hole openings and said nozzle openings can be adjusted.

* * * * *